US008573162B2

(12) United States Patent
Sasaki et al.

(10) Patent No.: US 8,573,162 B2
(45) Date of Patent: Nov. 5, 2013

(54) BOILER

(75) Inventors: Tsutomu Sasaki, Matsuyama (JP); Ryo Miyagawa, Matsuyama (JP); Tetsuji Namoto, Matsuyama (JP); Koji Miura, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 234 days.

(21) Appl. No.: 13/121,049

(22) PCT Filed: Aug. 6, 2009

(86) PCT No.: PCT/JP2009/003763

§ 371 (c)(1),
(2), (4) Date: Mar. 25, 2011

(87) PCT Pub. No.: WO2010/131300

PCT Pub. Date: Nov. 18, 2010

(65) Prior Publication Data

US 2012/0042839 A1 Feb. 23, 2012

(30) Foreign Application Priority Data

May 15, 2009 (JP) ..... 2009-119304

(51) Int. Cl.
*F22D 5/26* (2006.01)

(52) U.S. Cl.
USPC ..... 122/448.3; 122/18.4

(58) Field of Classification Search
USPC ..... 122/18.4, 448.1, 448.3
See application file for complete search history.

(56) References Cited

U.S. PATENT DOCUMENTS

| | | | | |
|---|---|---|---|---|
| 4,462,342 | A * | 7/1984 | Welden | 122/448.1 |
| 4,989,549 | A * | 2/1991 | Korenberg | 122/149 |
| 5,199,384 | A * | 4/1993 | Kayahara et al. | 122/18.4 |
| 5,273,001 | A * | 12/1993 | Kayahara et al. | 122/138 |
| 7,647,898 | B2 * | 1/2010 | Yoshinari et al. | 122/235.13 |
| 7,819,334 | B2 * | 10/2010 | Pouchak et al. | 237/8 R |
| 2009/0025655 | A1 * | 1/2009 | Tanaka et al. | 122/14.21 |

FOREIGN PATENT DOCUMENTS

| | | |
|---|---|---|
| JP | 57-150728 | 9/1982 |
| JP | 09-243058 | 10/2003 |
| JP | 2005-172365 | 6/2005 |
| JP | 2006-214629 | 8/2006 |
| JP | 2006-145121 | 3/2007 |

* cited by examiner

*Primary Examiner* — Gregory A Wilson
(74) *Attorney, Agent, or Firm* — Fox Rothschild LLP

(57) ABSTRACT

A combustion apparatus for boiler includes an air supply device that varies a supply amount of combustion air, a fuel supply device that varies a supply amount of fuel, and a control device that controls the air supply device and the fuel supply device, obtains the supply amounts in accordance with respective combustion stages, and realizes the multiple combustion stages. The the control device controls the air supply device and the fuel supply device so as to return to a predetermined combustion stage when a request for transition cancel is received during transition from the predetermined combustion stage to another combustion stage, and controls so as not to perform the transition to the other combustion stage until a predetermined time period has elapsed.

2 Claims, 3 Drawing Sheets

BOILER

INCORPORATION BY REFERENCE

This application is a 371 of International Application No. PCT/JP2009/003763 filed Aug. 06, 2009, which claims priority to Japanese Patent Application No. 2009-119304 filed May 15, 2009, the entire contents of which being hereby incorporated herein by reference.

BACKGROUND OF THE INVENTION (1) Field of the Invention

The present invention relates to a boiler as heat source equipment that transfers heat obtained by combusting fuel to water, and thereby transforms the water to steam or warm water, and particularly to transition control between stages when combustion control is performed in the plurality of combustion stages.

The present application claims the benefit of patent application number 2009-119304, filed in Japan on May 15, 2009, the subject matter of which is hereby incorporated herein by reference.

(2) Description of the Related Art

Conventionally, there has been provided a boiler that includes an air supply device capable of varying a supply amount of combustion air, and a fuel supply device capable of varying a supply amount of fuel, wherein a combustion amount can be controlled in a plurality of combustion states such as high combustion, low combustion, and stop, which is disclosed in Japanese Unexamined Patent Publication No. 2006-145121 and Japanese Unexamined Patent Publication No. 2005-172365, for example.

In this manner, in the boiler that controls the combustion amount in the plurality of combustion stages, a rotational rate of a fan of an air blower in the air supply device is increased or decreased, and an opening of a damper device is changed to thereby supply the combustion air of amounts required in the respective combustion states, and further a proportional control valve is used as a combustion valve, or a plurality of combustion valves are selectively opened and closed to thereby supply the fuel of the amounts required in the respective combustion states.

SUMMARY OF THE INVENTION

The conventional boiler is constituted such that even when a load fluctuation occurs in the middle of transition from the low combustion to the high combustion, and it is desired to cancel the transition to return to the low combustion, cancel processing is not accepted in view of occurrence of hunting, load on an inverter of the air blower and the like.

A certain amount of time is required for changing the rotational rate of the air blower and for changing the opening of the damper device, thus requiring a certain amount of time for transiting the combustion stage. This transition time becomes longer as a turndown ratio between the low combustion and the high combustion becomes larger, and thus, if in a boiler with a large turndown ratio, the constitution is such that the cancel during the transition is not accepted as in the conventional example, a gap between a required steam amount and a steam amount supplied from the boiler becomes large.

For example, if when a transition request to the low combustion is made during the transition from the low combustion to the high combustion, the transition to the high combustion cannot be cancelled, the boiler may stop due to overshoot of steam. Once the boiler stops, restart takes time, which disables load following, and leads to a possibility of stop of the whole system.

The present invention is achieved in light of the above-described problem, and an object thereof is to provide a boiler capable of preventing occurrence of a trouble accompanying transition cancel while enabling the transition cancel between combustion stages, in a boiler that controls a combustion amount in multiple combustion stages.

Means for Solving the Problem

In order to solve the above-described problem, according to a boiler of the present invention, a combustion apparatus for boiler includes an air supply device capable of varying a supply amount of combustion air, a fuel supply device capable of varying a supply amount of fuel, and control means for controlling the air supply device and the fuel supply device so as to obtain the supply amounts in accordance with respective combustion stages in order to realize the multiple combustion stages, wherein the control means controls the air supply device and the fuel supply device so as to return to a predetermined combustion stage when a request for transition cancel is received during transition from the predetermined combustion stage to another combustion stage, and controls so as not to perform the transition to the other combustion stage until a predetermined time period has elapsed.

Effect of the Invention

According to the present invention, in the boiler that controls the combustion amount in the multiple combustion stages, occurrence of a trouble accompanying the transition cancel can be favorably prevented while the transition cancel between the combustion stages is enabled.

DESCRIPTION OF REFERENCE SIGNS

Figure 1:
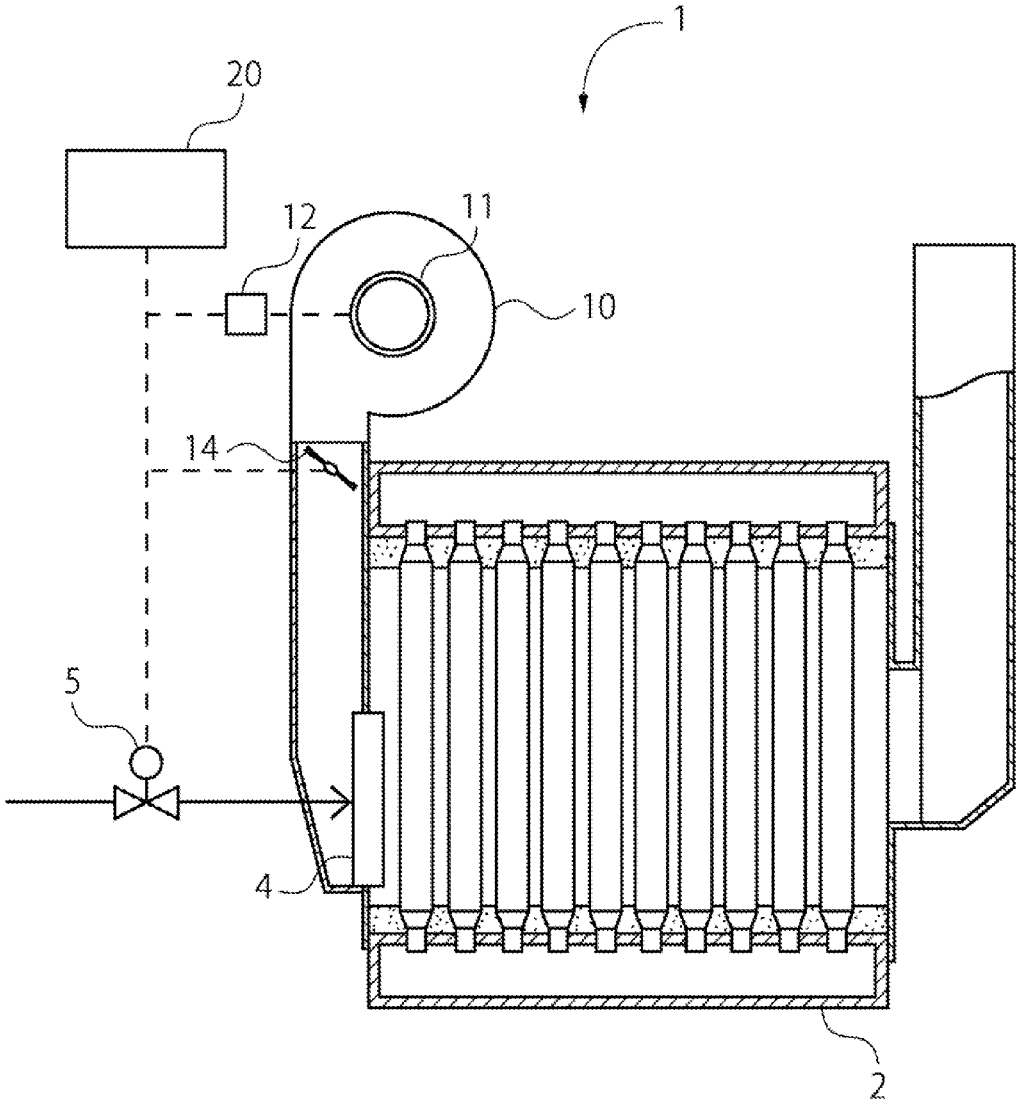
FIG. 1 is a schematic diagram schematically showing a constitution of a boiler according to an embodiment of the present invention.

1. boiler
2. can body
4. burner,
5. fuel valve
10. air blower
11. fan
12 inverter
14 damper
20 controller

DESCRIPTION OF THE PREFERRED EMBODIMENTS

Hereinafter, referring to the drawings, a boiler according to an embodiment of the present invention will be described. FIG. 1 is a schematic diagram schematically showing a constitution of the boiler according to the present embodiment. As shown in the same figure, a boiler 1 includes a can body 2, a burner 4, a fuel valve 5 as a fuel supply device, an air blower 10 as an air supply device, a damper 14, and a controller 20.

The fuel valve 5 is a proportional control valve capable of continuously varying an amount of fuel to be supplied to the burner 4, and is connected to a fuel supply source not shown. As the fuel, gaseous fuel such as gas, and liquid fuel such as oil are used. The air blower 10 includes a fan 11 whose frequency is continuously varied by an inverter 12, so that by changing a rotational rate, a supply amount of combustion air is adjusted.

The controller 20 to control the boiler 1 is connected to the fuel valve 5, the fan 11, and the damper 14 to control operations thereof. The controller 20 is connected to the fan 11 through the inverter 12. Moreover, a turndown ratio between low combustion and high combustion of the boiler 1 in the present embodiment is 1:5.

Figure 2:
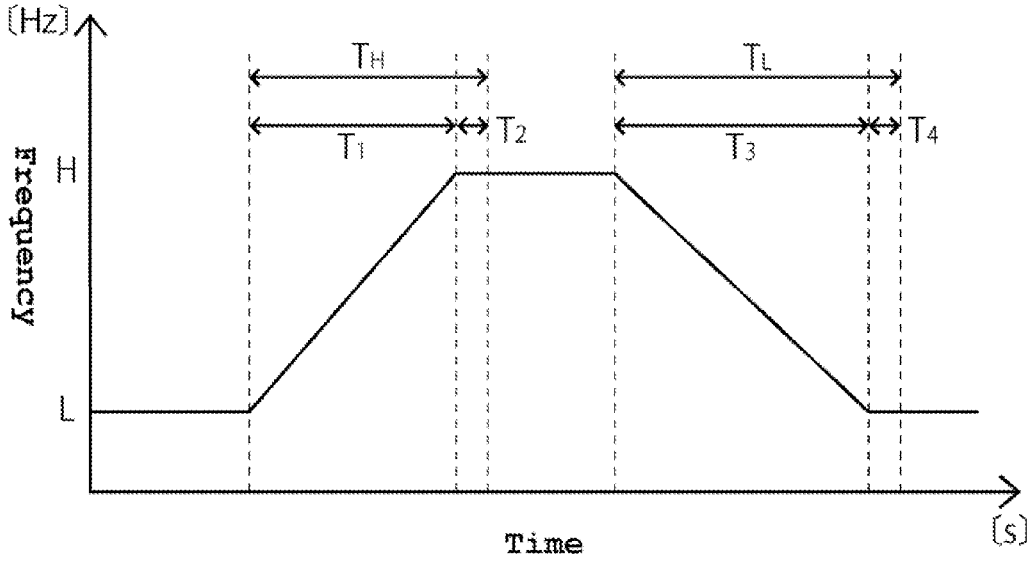
FIG. 2 is a diagram showing a basic control chart of the boiler according to the present embodiment.

Referring to FIG. 2, the combustion control in the boiler 1 will be described. FIG. 2 is a diagram showing a basic control chart of the boiler according to the present embodiment. The same figure shows a state where a combustion stage is transited from low combustion L to high combustion H, and further transited to the low combustion L. In the boiler 1, the supply amount of combustion air is adjusted by changing the frequency of the fan 11 in accordance with the combustion stage, and a horizontal axis in FIG. 2 indicates time [s], and a vertical axis indicates the frequency [Hz] of the fan 11. The controller 20 controls the fuel valve 5 so as to adjust the supply amount of the fuel in accordance with the frequency of the fan 11.

In the present embodiment, in the fan 11, the frequency in the low combustion is set to 18 Hz and the frequency in the high combustion is set to 80 Hz. $T_H$ in the figure indicates time required for becoming stable after the transition from L to H (high combustion retaining time) in the boiler 1, which is time obtained by adding time $T_1$ when the fan 11 transits from a low combustion frequency to a high combustion frequency, and a margin $T_2$ for limitation by the members such as the burner 4, the inverter 12, the damper 12 and the like.

$T_L$ indicates time required for becoming stable after the transition from H to L (low combustion retaining time) in the boiler 1, which is time obtained by adding time $T_3$ when the fan 11 transits from the high combustion frequency to the low combustion frequency, and a margin $T_4$ similar to the above-described $T_2$. The high combustion retaining time $T_H$ of the boiler 1 according to the present embodiment is set to 13 s, and the low combustion retaining time $T_L$ is set to 16 s.

Figure 3:
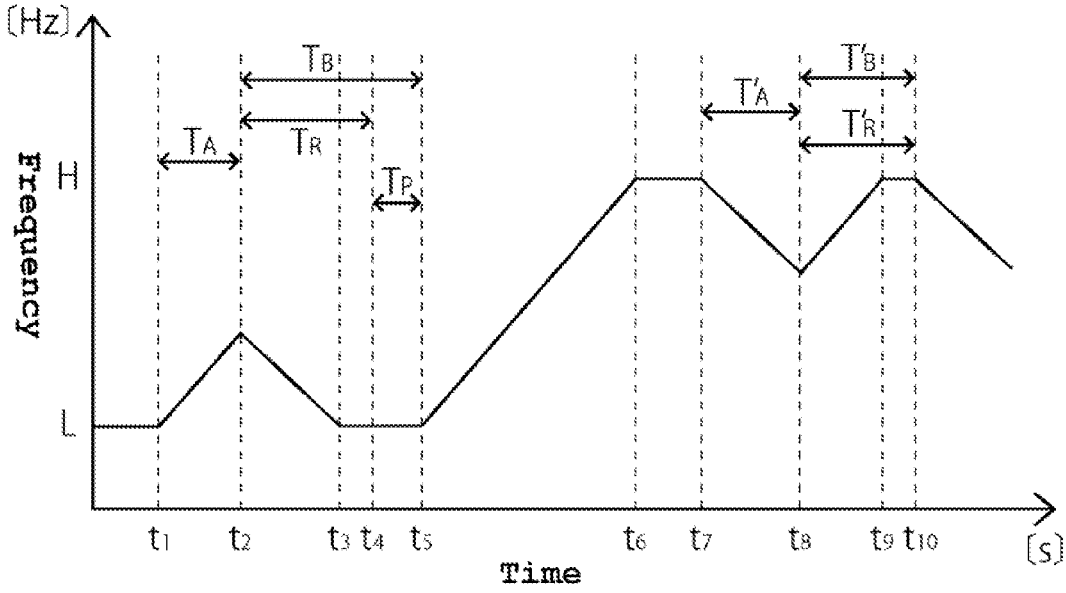
FIG. 3 is a diagram showing a control chart when transition cancel is made during transition between combustion stages of the boiler according to the present embodiment.

Referring to FIG. 3, the combustion control to a cancel request in the boiler 1 will be described. FIG. 3 is a diagram showing a control chart when a transition cancel request is made during the stage transition in the boiler according to the present embodiment. As shown in the same figure, the boiler 1 is in a low combustion stage until $t_1$, and at $t_1$, it receives the transition request to the high combustion and starts the stage transition. Specifically, by the control of the controller 20, the frequency of the fan 11, which is 18 Hz, is gradually increased, and the fuel valve 5 is gradually opened in response to the increase of the rotation frequency of the fan 11, thereby increasing the supply amount of the fuel.

Thereafter, when at $t_2$, a request for transition cancel, that is, a request to cancel the transition to the high combustion and return to the low combustion is made in the controller 20, the return is started in response to the transition cancel, and the frequency of the fan 11 is gradually decreased from $t_2$, because it is the first cancel in the stage transition L to H this time.

When the return is started at $t_2$, the controller 20 controls to prohibit any subsequent transition cancel again and not to accept the cancel in a predetermined time period. A recancel prohibition period $T_B$ is a time period in which return retaining time $T_R$, which is time required for the return, elapses, and the stage returns to the low combustion L ($t_2$ to $t_4$), and a predetermined addition prohibition period $T_P$ ($t_4$ to $t_5$) elapses, that is, $T_B=T_R+T_P$.

This addition prohibition period $T_P$ is a parameter decided in accordance with an installation situation of the boiler 1 and the like, and for example, can be set 0 to 5 seconds as needed. If time from the start of the transition to the high combustion H to the transition cancel ($t_1$ to $t_2$) is $T_A$, $T_B$ is found by $T_B=(T_A/T_H\times T_L)+TP$.

In FIG. 3, simultaneously with the elapse of the recancel prohibition period $T_B$ ($t_5$), the request for transition to the high combustion is received and the transition of the high combustion is started. After the transition to the high combustion, the transition to the low combustion is started at $t_7$, and then, a request for transition cancel is made at $t_8$. Since this transition cancel is the first cancel in the stage transition from H to L this time, the return is started, and the frequency of the fan 11 is gradually increased from $t_8$.

At $t_{10}$, return retaining time $T_R'$ elapses, so that the stage transits to the high combustion, and at the same time, a transition request to the low combustion is received, and the transition to the low combustion is started. This is because in the present embodiment, in the case of the return to the high combustion, TP=0 is set. Since the transition to the low combustion is performed when the load becomes lighter and steam pressure becomes. excessive, unless the transition to the low combustion is performed as soon as possible, there arises a possibility that the boiler 1 needs to be stopped. Therefore, in the present embodiment, the addition prohibition period $T_P$ when the stage returns to the high combustion is set to 0. Thus, a recancel prohibition period $T_B'$ when the stage returns to the high combustion is equal to the return retaining time $T_R'$.

Setting is made such that when the transition from the high combustion to the low combustion is cancelled a predetermined number of times in a predetermined time period, the controller 20 makes the forcible transition to the low combustion, and the transition to the high combustion is not accepted until a predetermined time period has elapsed. This is because once the transition to the low combustion is started, feed-water is started, so that a water level goes up, and if the cancel is repeated (for example, three times or more), the water level may go up too high. The above-described forcible transition to the low combustion can make the water level stable.

As described above, the present embodiment has been described in detail, and according to the present embodiment, the control is made such that when a request for cancel is made during the transition between the combustion stages, the cancel is accepted to return to the original combustion stage, and thus, the gap between the requested steam amount and the steam amount supplied from the boiler can be suppressed. Moreover, in the present embodiment, since once the cancel is accepted, anymore cancel is not accepted until the boiler returns to the original combustion stage, a trouble such as occurrence of hunting due to the repetition of the cancel can be prevented.

The embodiment of the present invention is not limited to the foregoing, but various modifications can be made within a range not departing from the gist of the present invention. For example, while in the above-described embodiment, the boiler of three-position control of the high combustion, the low combustion, and the stop has been described as one example, the present invention can be applied to any boiler that has multiple combustion stages such as a boiler of four-position control of high combustion, intermediate combustion, low combustion, and stop.

Moreover, while in the above-described embodiment, the control is made such that the cancel during the transition between the combustion stages is accepted only once, a constitution may be employed in which the cancel is accepted only twice. Moreover, while in the above-described embodiment, the control is made such that when the cancel during the transition between the combustion stages is accepted once, the transition request to the other combustion stage is not accepted until the boiler returns to the original combustion stage (until the return retaining time $T_R$ has elapsed), the control need not be such that the cancel is not accepted until the boiler completely returns to the original combustion stage, and for example, the recancel prohibition period $T_B$ may be a predetermined time period until the boiler returns to a vicinity of the original combustion stage.

Moreover, while in the above-described embodiment, the proportional control valve is used as the fuel supply device capable of varying the supply amount of the fuel, it is obvious that any other appropriate member can be used, as long as it can vary the supply amount. For example, it may be a supply device in which a plurality of electromagnetic valves are arranged in parallel, and are selectively opened and closed to thereby adjust the supply amount.

What is claimed is:

1. A combustion apparatus for boiler comprising:

an air supply device configured to vary a supply amount of combustion air;

a fuel supply device configured to vary a supply amount of fuel; and a control device configured to control the air supply device and the fuel supply device, obtain the supply amounts in accordance with respective combustion stages, and realize the multiple combustion stages, wherein the control device controls the air supply device and the fuel supply device so as to return to a predetermined combustion stage when a request for transition cancel is received during transition from the predetermined combustion stage to another combustion stage, and controls so as not to perform the transition to the other combustion stage until a predetermined time period has elapsed.

2. The combustion apparatus for boiler according to claim 1, wherein the predetermined time period is at least a time period until the boiler returns to the predetermined combustion stage by the transition cancel.

* * * * *